US008590681B2

(12) United States Patent
Shrewsbury et al.

(10) Patent No.: US 8,590,681 B2
(45) Date of Patent: Nov. 26, 2013

(54) CARRYING CASE WITH ENCLOSED HANDLE

(75) Inventors: Polly J. Shrewsbury, Austin, TX (US); Judy S. Im, Austin, TX (US); William M. Dieter, Portland, OR (US)

(73) Assignee: Pollyseon, LLC, Austin, TX (US)

( * ) Notice: Subject to any disclaimer, the term of this patent is extended or adjusted under 35 U.S.C. 154(b) by 260 days.

(21) Appl. No.: 12/766,856

(22) Filed: Apr. 23, 2010

(65) Prior Publication Data

US 2011/0259691 A1 Oct. 27, 2011

(51) Int. Cl.
*A45C 13/22* (2006.01)
*A45C 13/26* (2006.01)

(52) U.S. Cl.
USPC ..... 190/39; 190/109; 190/115; 206/372; 206/581; 383/14

(58) Field of Classification Search
USPC ..... 190/101.106, 109, 112, 903.39, 122, 190/108, 126, 115; 206/372, 420, 450, 575, 206/581, 767; 383/4, 19, 38, 40, 14; 220/4.24; 150/120, 128; 281/43; 402/73
See application file for complete search history.

(56) References Cited

U.S. PATENT DOCUMENTS 504,840 A * 9/1893 Krick ..... 190/108
513,726 A * 1/1894 Potts ..... 217/8
1,274,003 A * 7/1918 Christie ..... 190/111
1,711,349 A * 4/1929 Howard ..... 190/111
1,983,036 A * 12/1934 Kaufmann ..... 190/109
D135,358 S * 3/1943 Botham ..... D3/274
2,334,895 A * 11/1943 Bracken ..... 190/111
2,458,233 A * 1/1949 Wemyss ..... 190/19
2,493,182 A * 1/1950 Beder ..... 190/109
2,556,066 A * 6/1951 Cline ..... 190/111
2,667,199 A * 1/1954 Knee ..... 150/115
3,310,905 A * 3/1967 Davis et al. ..... 43/57.1
3,339,824 A * 9/1967 Luke ..... 383/25
3,693,868 A * 9/1972 Rich ..... 383/40
4,090,593 A * 5/1978 Koff ..... 190/103
4,421,127 A * 12/1983 Geer ..... 132/294
5,052,555 A * 10/1991 Harmon ..... 206/315.11
5,178,246 A * 1/1993 Kramer ..... 190/109
5,560,476 A * 10/1996 Lee ..... 206/38

(Continued)

FOREIGN PATENT DOCUMENTS

GB 1526193 * 9/1978
WO WO 2007/014804 A1 * 2/2007

OTHER PUBLICATIONS

Beverage Factory Website, http://www.beveragefactory.com/wine/accessories/1bottlecases.shtml (captured May 31, 2010).

(Continued)

*Primary Examiner* — Sue A Weaver
(74) *Attorney, Agent, or Firm* — Witkowski Law

(57) ABSTRACT

A carrying case including a first container having a first perimeter around a first opening and a second container comprising a second perimeter around a second opening, a first portion of the second perimeter being coupled to a first portion of the first perimeter to form a foldable interface between the first container and the second container; and a handle coupled to the foldable interface, a second portion of the first perimeter being configured to removably couple to a second portion of the second perimeter to enclose the handle of the first and second containers.

6 Claims, 4 Drawing Sheets

(56) References Cited

U.S. PATENT DOCUMENTS

| | | | | |
|---|---|---|---|---|
| 5,642,809 | A * | 7/1997 | Mayville | 206/204 |
| 6,837,346 | B2 * | 1/2005 | Hollingsworth | 190/11 |
| 7,318,542 | B2 * | 1/2008 | Godshaw et al. | 224/674 |
| 2004/0104136 | A1 * | 6/2004 | Schonenbach | 206/317 |
| 2004/0188204 | A1 * | 9/2004 | Wilkins-Langie et al. | 190/111 |
| 2005/0189388 | A1 * | 9/2005 | Godshaw et al. | 224/607 |

OTHER PUBLICATIONS

Winestuff Website, http://www.winestuff.com/acatalog/Wine_Bags.html?gclid=CPyep_2U-qACFQ8hDQodoEW4vQ (captured May 31, 2010).

* cited by examiner

CARRYING CASE WITH ENCLOSED HANDLE

BACKGROUND

1. Technical Field

This disclosure relates generally to the field of carrying cases. More particularly, the disclosure relates to carrying cases for storage, transport and display of hair styling and other cosmetology equipment.

2. Background Art

Professional hair stylists spend significant sums of money on their cosmetology equipment. They frequently carry this expensive equipment around. Independent stylists generally bring their cosmetology equipment to and from their client's work sites each day. Even stylists who work at a station in a salon generally carry their equipment back and forth each day because they do not want to leave their expensive equipment at the salon overnight.

Some stylists use a gym bag to carry their equipment. Gym bags generally do not have sufficient cushioning to protect the individual pieces from each other and from external impact. Additionally, gym bags generally do not have sufficient partitioning to allow for organization of the equipment for easy storage and retrieval. Furthermore, gym bags do not project the professional and sophisticated image that cosmetologists generally want to convey to their clientele.

It is desirable for bags to provide convenient transportation of cosmetology equipment, efficient access to that equipment, and protection of that equipment from damage or breakage.

SUMMARY

A carrying case including a first container having a first perimeter around a first opening and a second container comprising a second perimeter around a second opening, a first portion of the second perimeter being coupled to a first portion of the first perimeter to form a foldable interface between the first container and the second container; and a handle coupled to the foldable interface, a second portion of the first perimeter being configured to removably couple to a second portion of the second perimeter to enclose the handle of the first and second containers.

DETAILED DESCRIPTION

Various examples of embodiments of a carrying case will be described below with reference to the drawings. These exemplary embodiments are illustrative and are not to be construed as limiting.

In some embodiments, the carrying case is adapted to be used in at least two configurations. In a closed configuration, the carrying case contains and protects the contents for storage or transport. In an open configuration, the carrying case provides access to the contents. The illustrated embodiments of the carrying case are described with reference to contents that include brushes, combs and other incidentals for professional hair stylists. In other embodiments, the carrying case may be adapted to store other contents and can be used for other personal and professional applications.

Figure 1:
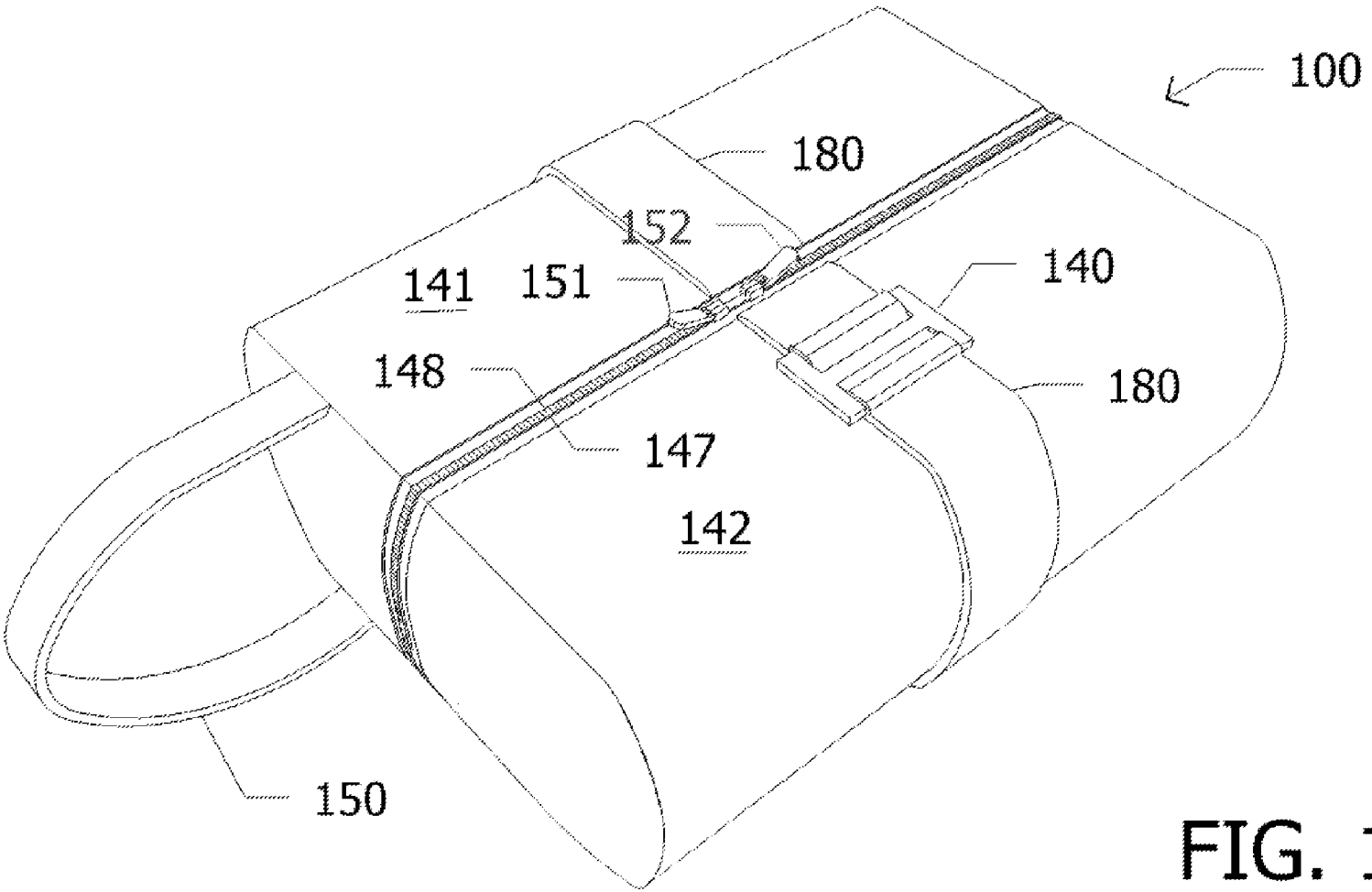
FIG. 1 illustrates one embodiment of carrying case.

FIG. 1 illustrates one embodiment of a carrying case 100. The carrying case 100 is approximately 11 inches wide, 8 inches long and 4 inches deep. The carrying case 100 includes a container 141 and a container 142 foldably coupled to each other along a first portion of the perimeters (not shown) and removably coupled using zipper teeth 147 and zipper teeth 148 along a second portion of the perimeters. An ornamental buckle 140 is fixed on the surface of the carrying case 100 and a leather strap 180 wraps the carrying case 100. A strap 150 is sewn to the container 141 to allow someone to carry the carrying case 100 by the strap 150. Zipper teeth 147 and zipper teeth 148 along a portion of the perimeter of the container 141 and the container 142. The zipper teeth 147 and the zipper teeth 148 are removably coupled to each other using a zipper slider 151 and a zipper slider 152.

The container 141 and the container 142 are formed by sewing an outer shell (illustrated) and inner shell (opposite side, not shown in FIG. 1). The outer shell is formed of 1000 denier nylon and the inner shell is formed of polyester lining. In some embodiments, the containers are formed of panel sections and layers of material are inserted in between the outer and inner shell in each panel section. These layers may include a stiffener material such as polyethylene to maintain the shape of the carrying case 100 and a foam layer such as polyurethane to protect the contents from external forces.

Figure 2:
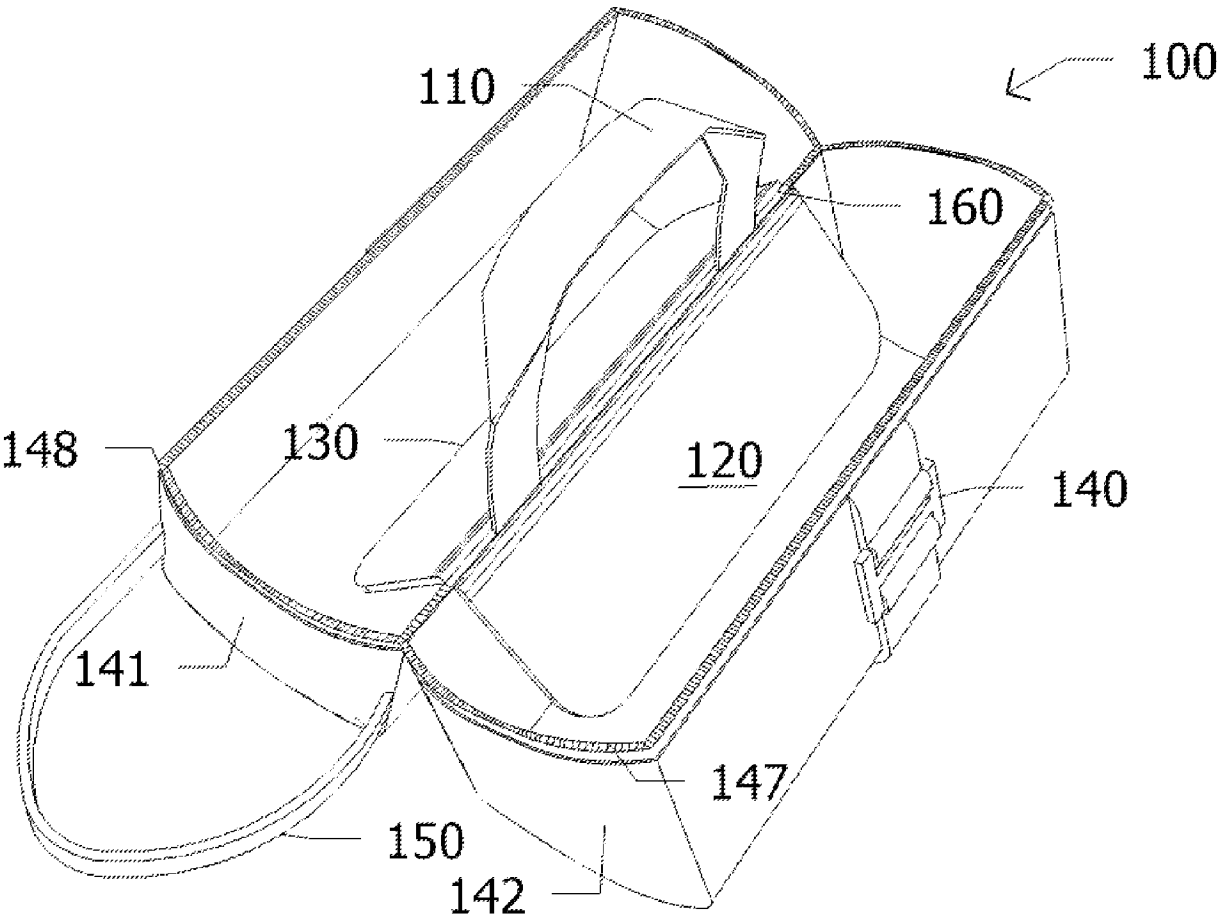
FIG. 2 illustrates one embodiment of the carrying case.

FIG. 2 illustrates a top view of the carrying case 100 in an open configuration. The container 141 and the container 142 are foldably coupled at an interface 160 between a first portion of the perimeter of an opening in the container 141 and a first portion of the perimeter of an opening in the container 142. In some embodiments, the containers are foldably coupled together by sewing the pieces together. In other embodiments, hinges may be used to foldably couple the container 141 and the container 142. Other methods of foldably coupling the container 141 and the container 142 may be used.

The container 141 and the container 142 are removably coupled between a second portion of the perimeter of an opening in the container 141 and a second portion of the perimeter of an opening in the container 142. The second portions of the perimeters of the openings of the container 141 and the container 142 are removably coupled using a zipper sliders (not shown) sliding along zipper teeth 147 and zipper teeth 148. In other embodiments the second portions of the perimeters of the container 141 and the container 142 are removably coupled using one or more buttons. It will be apparent to one skilled in the art that other methods of removably coupling the second portions of the perimeters of the container 141 and the container 142 may be used.

A handle 110 is coupled to the interface 160. In some embodiments, a flap 120 and a flap 130 are coupled to the interface 160. The flaps contain one or more pouches formed by clear plastic enclosed with a zipper. In some embodiments, the carrying case 100 is used to carry brushes and the flap 120 and the flap 130 are used to store smaller items such as combs and bobby pins. It will be apparent to one skilled in the art that other contents may be stored in the carrying case 100.

Figure 3:
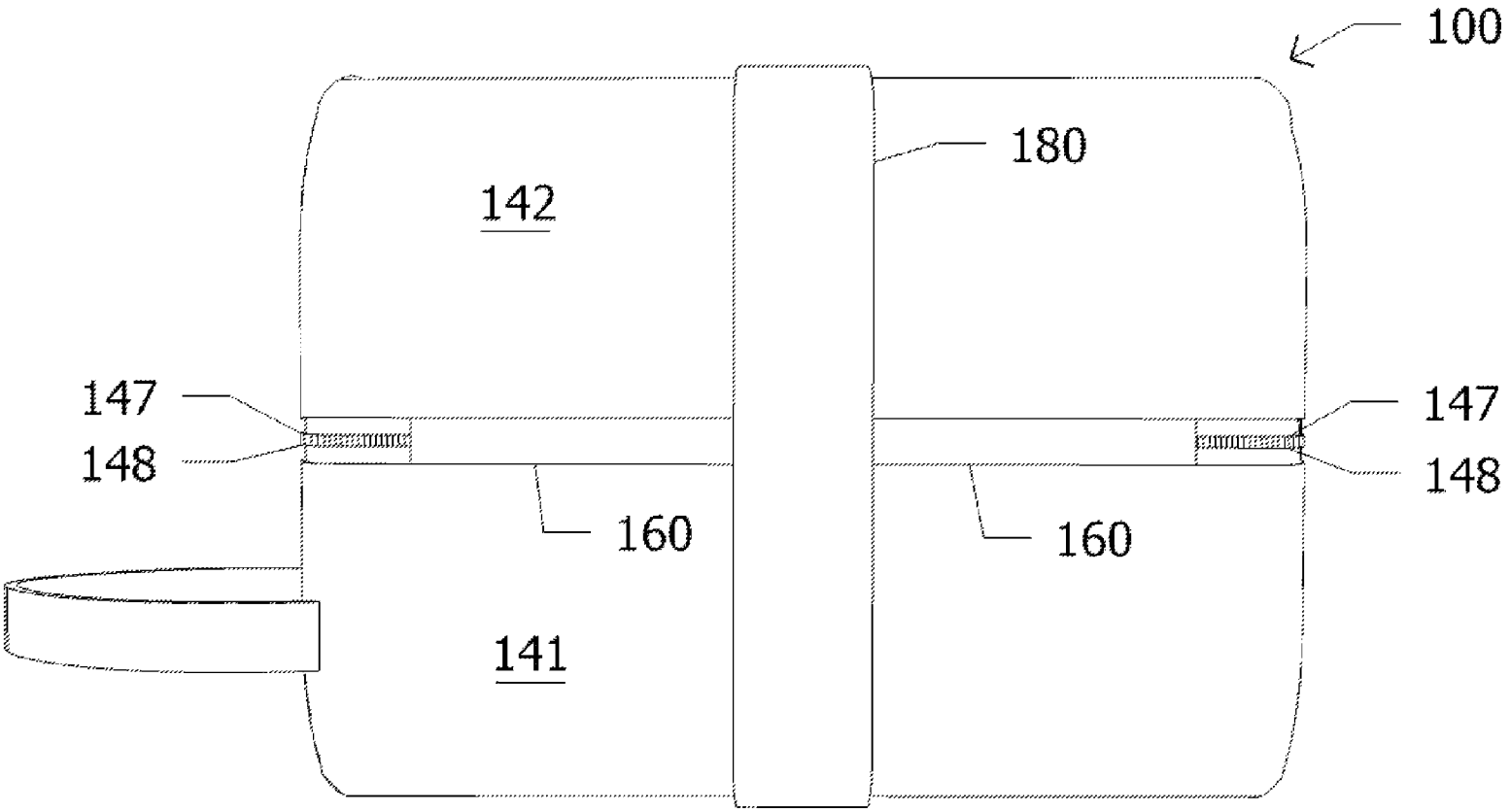
FIG. 3 illustrates a bottom view of one embodiment of the carrying case.

FIG. 3 illustrates a bottom view of one embodiment of the carrying case 100.

A first portion of the perimeters of the container 141 and the container 142 are foldably coupled to each other at the interface 160. The leather strap 180 crosses over the interface 160. In some embodiments, the containers are foldably coupled together by sewing the container 141 and the container 142 together. In other embodiments, hinges may be used to foldably couple the container 141 and the container 142. Other methods of foldably coupling the container 141 and the container 142 may be used. A second portion of the perimeters of the container 141 and the container 142 are removably coupled to each other using the zipper teeth 147 and the zipper teeth 148.

Figure 4:
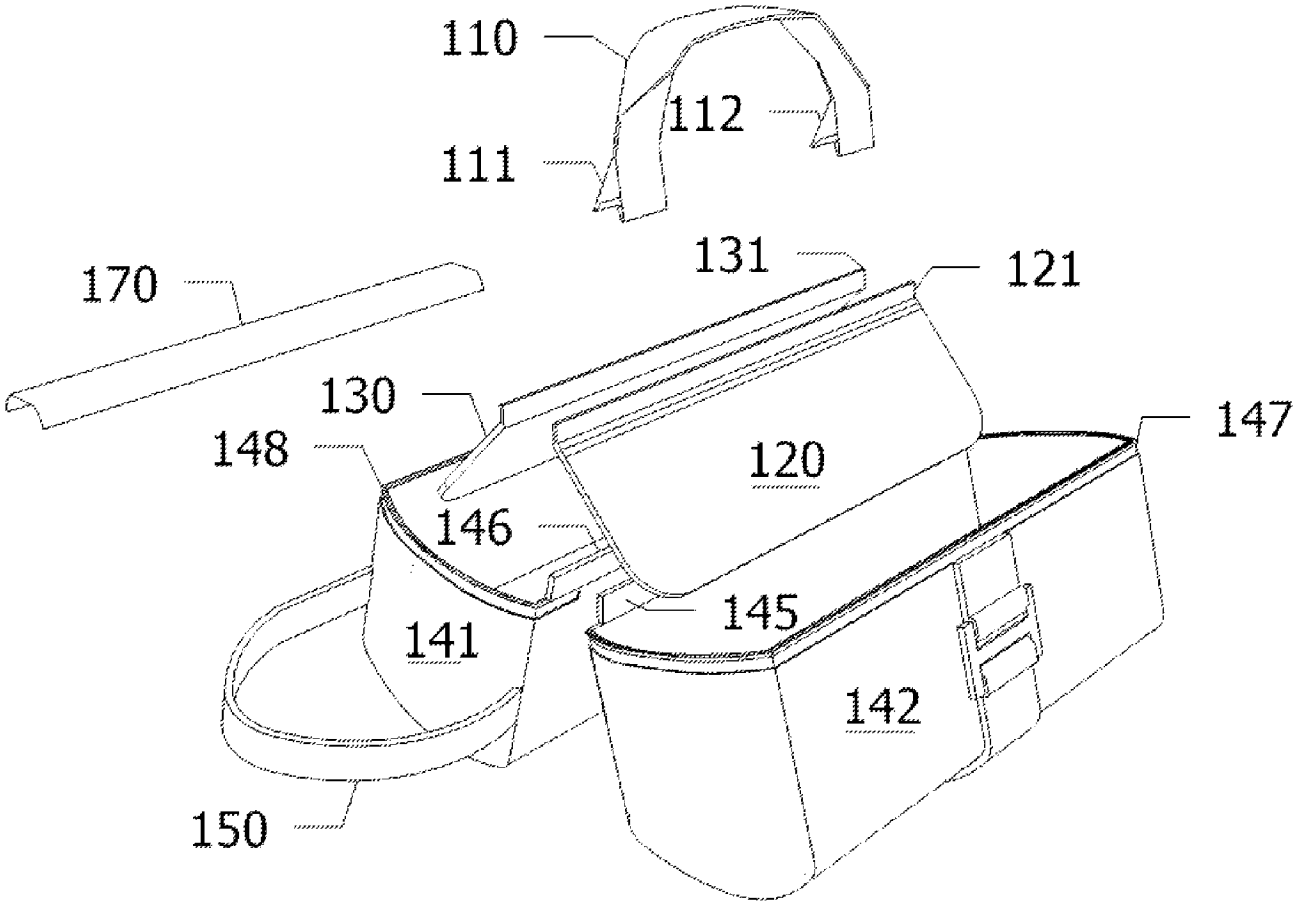
FIG. 4 shows an exploded view of a portion of the carrying case.

FIG. 4 illustrates an exploded view of the interface between the container 141 and the container 142 to illustrate an exemplary assembly.

A lip 145 along a first portion of the perimeter of the opening of the container 142 is aligned flat with a lip 146 along a first portion of the perimeter of the opening of the container 141. A lip 121 of the flap 120 is aligned flat with the lip 145. A lip 131 of the flap 130 is aligned flat with the lip 146.

The handle 110 is formed of leather having a y-shaped end 111 and a y-shaped end 112. A cover 170 is inserted over the y-ends of 111 and the y-ends of 112 such that the handle 110 is laterally centered along the cover 170. The extreme ends of the y-shaped end 111 and the y-shaped end 112 are wrapper under the cover 170. The cover 170 is then wrapped around the four lips and the cover and handle are sewn together with the lips to form the interface 160. The interface 160 foldably couples the container 142 and the container 141.

A second portion of the perimeter of the opening in the container 142 has zipper teeth 147. A second portion of the perimeter of the opening in the container 141 has zipper teeth 148. A zipper slider (not shown) is used to removably couple the second portion of the perimeter of the openings in the top and containers together.

The above description introduces numerous specific details, such as measurements and materials, to provide a thorough understanding of, and enabling description for, the illustrated embodiments of the carrying case. One skilled in the art will recognize that these embodiments can be practiced without one or more of these specific details, or with other components. In some instances well known components are not described in detail to avoid obscuring aspects of the disclosed embodiments.

For example, the embodiments are described holding brushes, combs and bobby pins, but other objects may be stored, transported or retrieved from the carrying case. For example, the objects may include other hair styling tools, hair styling products or cosmetics.

The embodiments are described with reference to pouches on the flaps, but other means for storing objects may be used. The means for storing objects can include pockets, hooks, and loops. For example a loop may be formed on a flap to allow the handle of a brush to be slid into it. The means for storing objects can include Velcro strips configured to interface with corresponding Velcro strips on the objects to be stored.

It will be apparent to one skilled in the art that the embodiments are not limited to any particular type of contents and that the means for storing the objects on the flaps are to be interpreted broadly to include all well-known means for storing objects. The means for storing objects may be implemented in various types, layouts and sizes depending on the intended application and the corresponding objects to be stored.

What is claimed is:

1. An apparatus having an open configuration and a closed configuration, the apparatus comprising:

a first container comprising a first perimeter around a first opening whereby the first container is accessible through the first opening in the open configuration;

a second container comprising a second perimeter around a second opening whereby the second container is accessible through the second opening in the open configuration, a first portion of the second perimeter being coupled to a first portion of the first perimeter to form a foldable interface between the first container and the second container, a second portion of the first perimeter being configured to removably couple to a second portion of the second perimeter, the second portion of the first perimeter being coupled to the second portion of the second perimeter in the closed configuration;

a storage means coupled to the foldable interface; and a handle coupled to the foldable interface, the handle being accessible for carrying the apparatus in the open configuration, the handle being enclosed by the first and second containers in the closed configuration whereby the handle is not accessible.

2. The apparatus of claim 1 wherein the second portion of the first perimeter and the second portion of the second perimeter comprise zipper teeth that are configured to removably couple to each other using a zipper slider.

3. The apparatus of claim 1 wherein the foldable interface comprises a hinge, the hinge foldably coupling the first portion of the first perimeter to the first portion of the second perimeter.

4. An apparatus having an open configuration and a closed configuration, the apparatus comprising:

a first container comprising a first perimeter around a first opening whereby the first container is accessible through the first opening in the open configuration;

a second container comprising a second perimeter around a second opening whereby the second container is accessible through the second opening in the open configuration, a first portion of the second perimeter being coupled to a first portion of the first perimeter to form a foldable interface between the first container and the second container, a second portion of the first perimeter being configured to removably couple to a second portion of the second perimeter, the second portion of the first perimeter being coupled to the second portion of the second perimeter in the closed configuration;

a pouch coupled to the foldable interface; and a handle coupled to the foldable interface, the handle being accessible for carrying the apparatus in the open configuration, the handle being enclosed by the first and second containers in the closed configuration whereby the handle is not accessible.

5. The apparatus of claim 4 wherein the second portion of the first perimeter and the second portion of the second perimeter comprise zipper teeth that are configured to removably couple to each other using a zipper slider.

6. The apparatus of claim 4 wherein the foldable interface comprises a hinge, the hinge foldably coupling the first portion of the first perimeter to the first portion of the second perimeter.

* * * * *